US006122953A

United States Patent [19]

Markarian

[11] Patent Number: 6,122,953

[45] Date of Patent: Sep. 26, 2000

[54] UNIVERSAL SIDE IMPACT AUTO PULLER

[76] Inventor: Hofseb K. Markarian, 4988 Parker Street, Burnaby, BC, Canada, V5B 1Z6

[21] Appl. No.: 09/428,854

[22] Filed: Oct. 28, 1999

[51] Int. Cl.[7] ..... B21J 13/08

[52] U.S. Cl. ..... 72/457; 72/293; 72/705

[58] Field of Search ..... 72/293, 308, 457, 72/460, 477, 705

[56] References Cited

U.S. PATENT DOCUMENTS 3,610,022 10/1971 Lincourt ..... 72/457
3,797,295 3/1974 Sonchez ..... 72/705
5,247,824 9/1993 Horan ..... 72/705
5,335,533 8/1994 Rehus ..... 72/705

*Primary Examiner*—Ed Tolan

[57] ABSTRACT

A universal side impact auto puller for facilitating pulling of a door post back into proper position after an auto accident. The universal side impact auto puller includes a main member having three substantially planar faces, opposite sides of each face being integrally joined to a respective one of said three faces such that said faces form a triangular wall. A pair of adapters are provided for engaging cutouts in said faces for coupling the main member to a door post of a vehicle.

9 Claims, 3 Drawing Sheets

UNIVERSAL SIDE IMPACT AUTO PULLER

BACKGROUND OF THE INVENTION

1. Field of the Invention

The present invention relates to auto pullers and more particularly pertains to a new universal side impact auto puller for facilitating pulling of a door post back into proper position after an auto accident.

2. Description of the Prior Art

The use of auto pullers is known in the prior art. More specifically, auto pullers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,335,533; 3,338,086; 3,879,814; 4,770,025; 4,248,078; 5,535,973; and U.S. Pat. No. Des. 311,316.

While these devices fulfill their respective, particular objectives and requirements, the aforementioned patents do not disclose a new universal side impact auto puller. The inventive device includes a main member having three substantially planar faces, opposite sides of each face being integrally joined to a respective one of said three faces such that said faces form a triangular wall. Adapters are provided for engaging cutouts extending through the wall of the main member for coupling the main member to a door post of a vehicle.

In these respects, the universal side impact auto puller according to the present invention substantially departs from the conventional concepts and designs of the prior art, and in so doing provides an apparatus primarily developed for the purpose of facilitating pulling of a door post back into proper position after an auto accident.

SUMMARY OF THE INVENTION

In view of the foregoing disadvantages inherent in the known types of auto pullers now present in the prior art, the present invention provides a new universal side impact auto puller construction wherein the same can be utilized for facilitating pulling of a door post back into proper position after an auto accident.

The general purpose of the present invention, which will be described subsequently in greater detail, is to provide a new universal side impact auto puller apparatus and method which has many of the advantages of the auto pullers mentioned heretofore and many novel features that result in a new universal side impact auto puller which is not anticipated, rendered obvious, suggested, or even implied by any of the prior art auto pullers, either alone or in any combination thereof.

To attain this, the present invention generally comprises a main member having three substantially planar faces, opposite sides of each face being integrally joined to a respective one of said three faces such that said faces form a triangular wall. A pair of adapters are provided for engaging cutouts in said faces for coupling the main member to a door post of a vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new universal side impact auto puller apparatus and method which has many of the advantages of the auto pullers mentioned heretofore and many novel features that result in a new universal side impact auto puller which is not anticipated, rendered obvious, suggested, or even implied by any of the prior art auto pullers, either alone or in any combination thereof.

It is another object of the present invention to provide a new universal side impact auto puller that may be easily and efficiently manufactured and marketed.

It is a further object of the present invention to provide a new universal side impact auto puller that is of a durable and reliable construction.

An even further object of the present invention is to provide a new universal side impact auto puller which is susceptible of a low cost of manufacture with regard to both materials and labor, and which accordingly is then susceptible of low prices of sale to the consuming public, thereby making such universal side impact auto puller economically available to the buying public.

Still yet another object of the present invention is to provide a new universal side impact auto puller which provides in the apparatuses and methods of the prior art some of the advantages thereof, while simultaneously overcoming some of the disadvantages normally associated therewith.

Still another object of the present invention is to provide a new universal side impact auto puller for facilitating pulling of a door post back into proper position after an auto accident.

Yet another object of the present invention is to provide a new universal side impact auto puller which includes a main member having three substantially planar faces, opposite sides of each face being integrally joined to a respective one of said three faces such that said faces form a triangular wall. A pair of adapters are provided for engaging cutouts in said faces for coupling the main member to a door post of a vehicle.

Still yet another object of the present invention is to provide a new universal side impact auto puller that is designed to engage all of the commonly found door post assemblies in vehicles both foreign and domestic to the United States.

Even still another object of the present invention is to provide a new universal side impact auto puller that provides a unique triangular shape to permit pulling from various directions to reposition a misaligned door post in a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
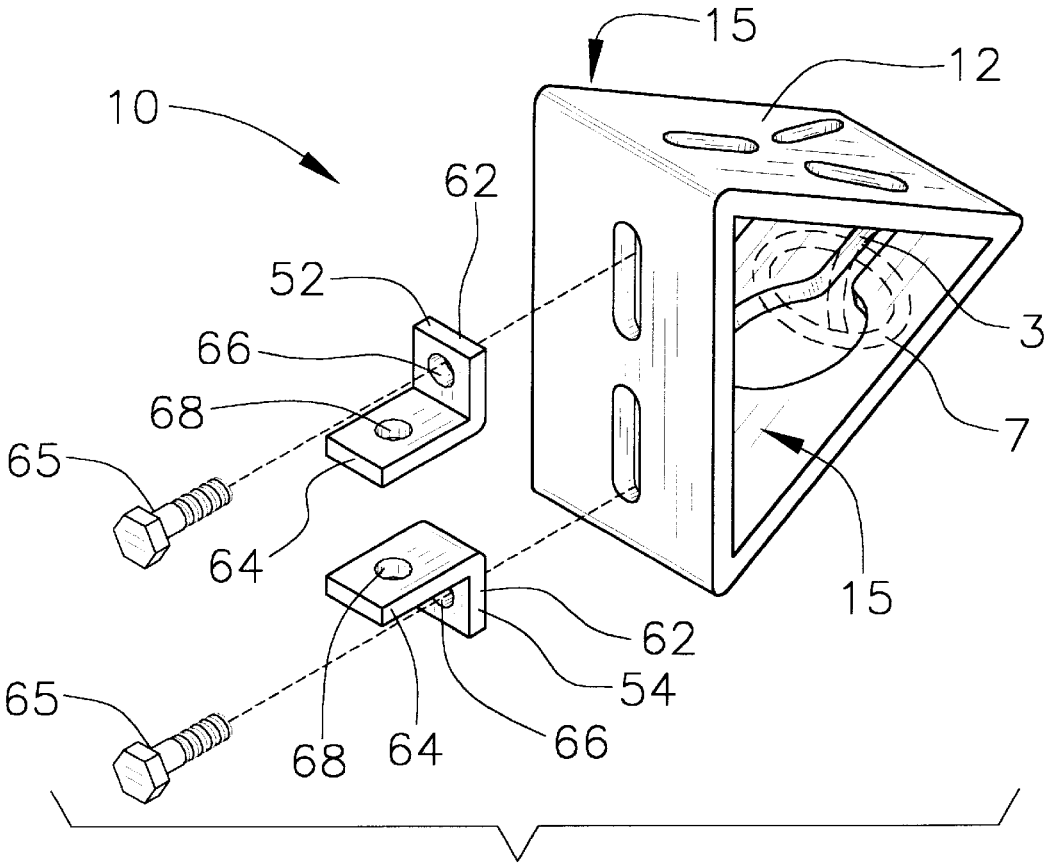
FIG. 1 is a schematic perspective view of a new universal side impact auto puller according to the present invention.
Figure 2:
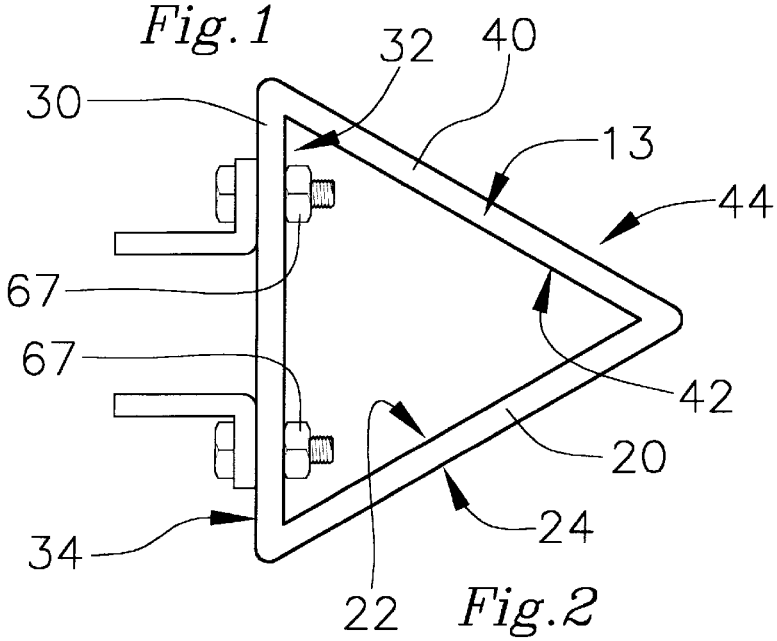
FIG. 2 is a schematic side view of the present invention.
Figure 3:
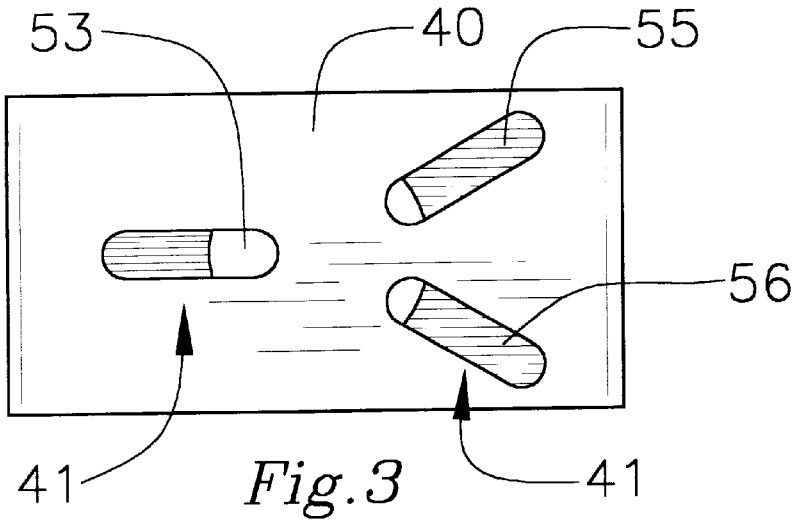
FIG. 3 is a schematic rear view of the present invention.
Figure 4:
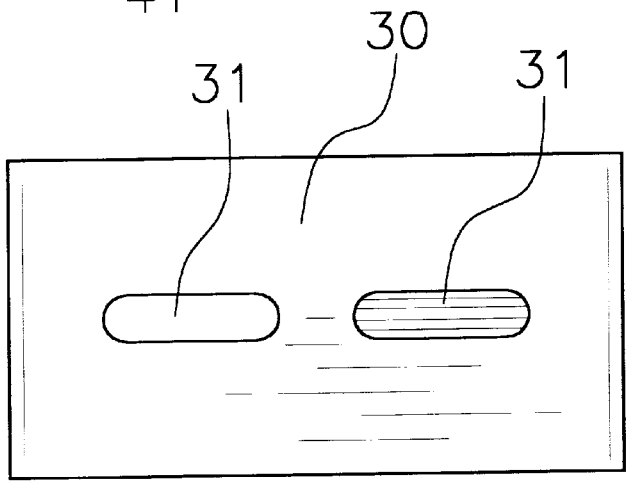
FIG. 4 is a schematic front view of the present invention.
Figure 5:
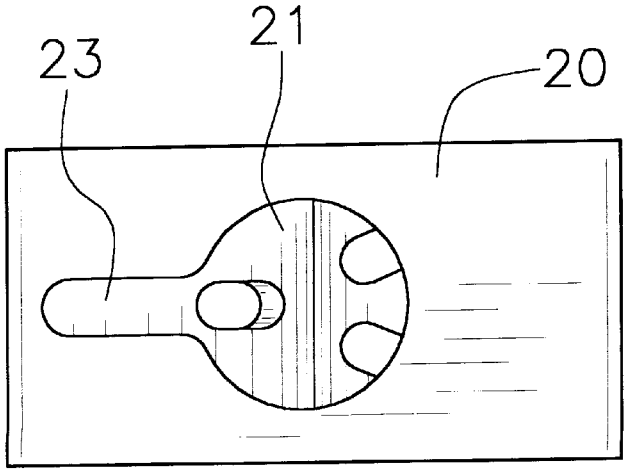
FIG. 5 is a schematic bottom view of the present invention.

With reference now to the drawings, and in particular to FIGS. 1 through 6 thereof, a new universal side impact auto puller embodying the principles and concepts of the present invention and generally designated by the reference numeral 10 will be described.

As best illustrated in FIGS. 1 through 6, the universal side impact auto puller 10 generally comprises a metal generally triangular main member 12 having three substantially planar sides 20, 30, and 40. Each planar side has a respective interior face 22, 32, and 42, and a respective exterior face 24, 34, and 44.

Figure 6:
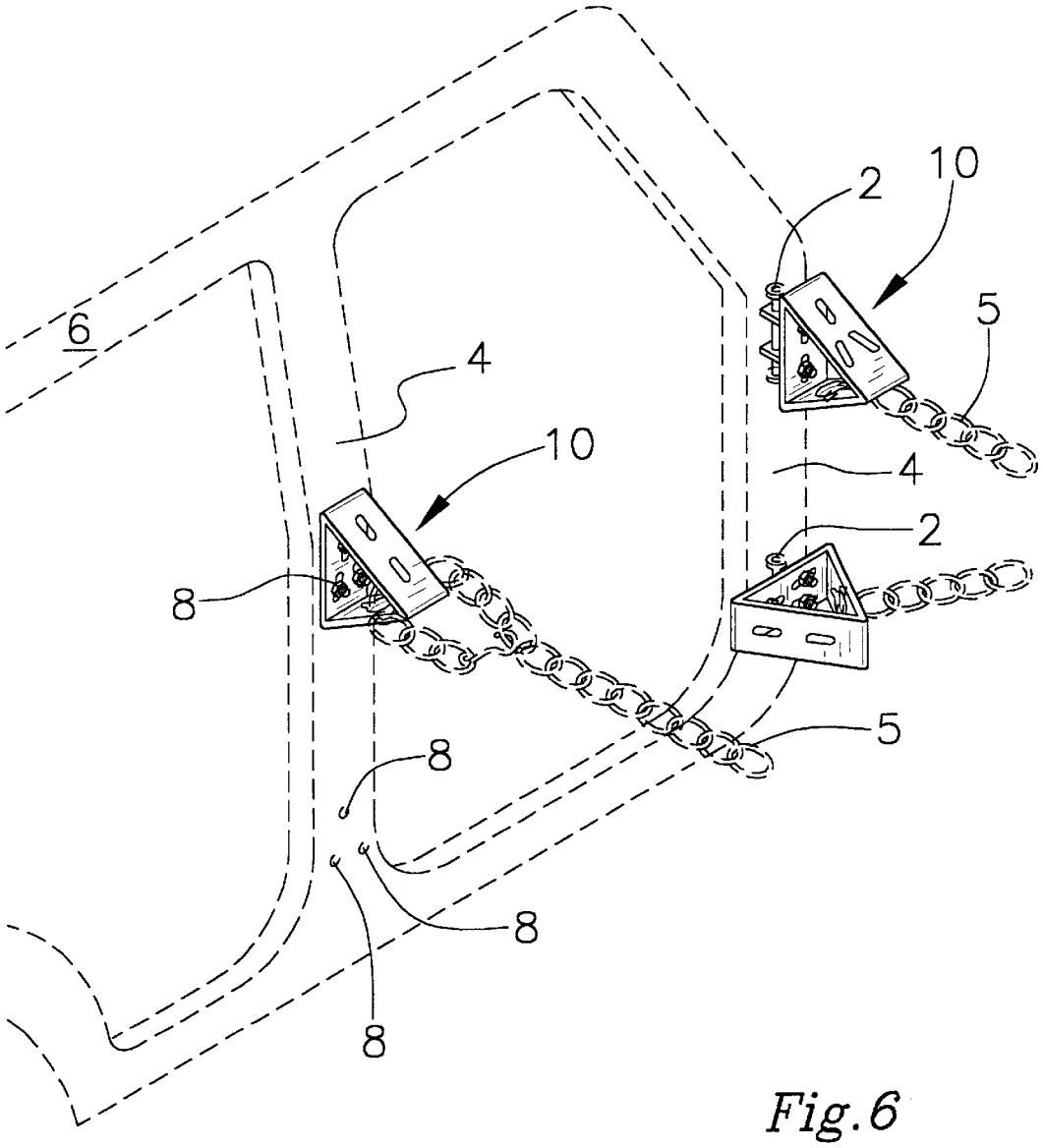
FIG. 6 is a schematic perspective view of the present invention in use.

The first one of the planar sides 20 has a generally round aperture 21 extending through the first planar side between the interior and exterior faces 22 and 24. The side 20 further includes a chain slot 23 extending outwardly from the aperture. The aperture is designed for passing a chain 5 through the aperture and the chain slot is designed for positioning a link 3 of the chain in the chain slot such that an adjacent link 7 in the chain is prevented from passing through the chain slot. Thus, the first side is designed for coupling to the chain to facilitate pulling of the main member using the chain. As seen in FIG. 6, the chain slot is particularly useful for pulling the main member forward or backward with respect to the orientation of the vehicle.

The planar sides are integrally joined together to form a triangular perimeter wall 13 having open ends 15. The perimeter wall is designed for receiving the chain through the open ends for coupling a link of the chain to another link of the chain such that the chain is coupled to the main member to facilitate pulling of the main member using the chain to realign the door post of the vehicle. Thus, the structure of the present invention permits multiple methods of attaching a chain to facilitate use of the tool assembly.

The second one of the planar sides 30 has a pair of door hinge slots 31 extending through the second planar side between the interior and exterior faces 32 and 34.

A pair of brackets 52 and 54 are designed for coupling to a respective one of the door hinge slots. Each of the brackets is designed for engaging a respective end of a door hinge 2 on a door post 4 of a vehicle 6. Thus, the tool assembly 10 is couplable to the vehicle door post to facilitate pulling the door post back into proper alignment after an accident.

The third one of the planar sides 40 has a plurality of bolt slots 41 extending through the third planar side between the interior and exterior faces 42 and 44. The bolt slots are configured such that the bolt slots are designed to be couplable to hinge bolts 8 on the door post of the vehicle.

In an embodiment, the door hinge slots are coaxially aligned with respect to each other for permitting sliding of the brackets within the door hinge slots to accommodate coupling to door hinges having a range of hinge lengths.

The plurality of bolt slots include a first bolt slot 53 having a longitudinal axis substantially aligned with a longitudinal axis of the third planar side. The plurality of bolt slots also include a second bolt slot 55 and a third bolt slot 56. The second and third bolt slots are angled with respect to each other such that respective longitudinal axes of the second and third bolt slots converge and intersect with each other and the longitudinal axis of the third planar side at a point. The angling is configured such that the bolt slots are designed for coupling to various bolt patterns used to attach door hinges to different vehicles whereby the tool assembly is designed for coupling to the door posts of different vehicles.

Each one of the pair of brackets includes a first and a second planar flange, 62 and 64 respectively. The second flange extends orthogonally from a side 63 of the first flange. Each first flange includes a bolt hole 66 extending through the first flange and each second flange includes a hinge post hole 68 extending through the second flange for attachment to a pin type hinge. The hinge post holes are alignable such that the hinge post holes are designed for engaging respective ends of the hinge post of a pin type hinge of the vehicle. A pair of bracket bolts 65 and a pair of bracket nuts 67 are used to secure the brackets to the hinge post and the main member.

The bracket bolts are designed for insertion through the bolt holes and the hinge post slots to engage the bracket nuts whereby the second planar side and the brackets are coupled to each other upon tightening of the bracket nuts on the bracket bolts. Thus, the tool assembly is designed for coupling to an exposed hinge post to facilitate pulling of the hinge post outwardly with respect to the vehicle to realign the door post of the vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A realignment tool assembly for realigning a door post of a vehicle, the device comprising:

a generally triangular main member having three substantially planar sides, each planar side having an interior face and an exterior face;

a first one of said planar sides having a generally round aperture extending through the first planar side, said first one of said sides further having a chain slot extending outwardly from said aperture;

a second one of said planar sides having a pair of door hinge slots extending through the second planar side;

a pair of brackets, each bracket being couplable to a respective one of said door hinge slots, said brackets each being adapted for engaging a respective end of a door hinge on the door post of the vehicle whereby the tool assembly is couplable to the vehicle door post; and a third one of said planar sides having a plurality of bolt slots extending through the third planar side, said bolt slots being configured such that said bolt slots are adapted to be couplable to hinge bolts on the door post of the vehicle.

2. The tool assembly of claim 1 wherein said door hinge slots are coaxially aligned with respect to each other for permitting sliding of the brackets within the door hinge slots to accommodate coupling to door hinges having a range of hinge lengths.

3. The tool assembly of claim 1 wherein the plurality of bolt slots include a first bolt slot, said first bolt slot having a longitudinal axis substantially aligned with a longitudinal axis of said third planar side.

4. The tool assembly of claim 3, further comprising:

said plurality of bolt slots including a second bolt slot and a third bolt slot, said second and third bolt slots being positioned such that respective longitudinal axes of the second and third bolt slots converge and intersect with each other and the longitudinal axis of the third planar side such that said plurality of bolt slots are adapted for coupling to various bolt patterns used to attach door hinges to different vehicles whereby said tool assembly is adapted for coupling to the door posts of different vehicles.

5. The tool assembly of claim of claim 1, further comprising:

said pair of brackets each having a first and a second planar flange, said second flange extending orthogonally from a side of said first flange, each first flange having a bolt hole extending through the first flange, each second flange having a hinge post hole extending through the second flange; and said hinge post holes being alignable such that said hinge post holes are adapted for engaging respective ends of the hinge post of the vehicle.

6. The tool assembly of claim 5, further comprising:

a pair of bracket bolts and a pair of bracket nuts; and said bracket bolts being for insertion through said bolt holes and said hinge post slots and engaging said bracket nuts whereby said second planar side and said brackets are coupled to each other such that said tool assembly is adapted to facilitate pulling of the hinge post outwardly with respect to the vehicle to realign the door post of the vehicle.

7. The tool assembly of claim 1 wherein said aperture is adapted for passing a chain through said aperture; and wherein said chain slot is adapted for positioning a link of the chain in the chain slot such that an adjacent link in the chain is prevented from passing through the chain slot whereby said first side is adapted for coupling to a chain to facilitate pulling of the main member using the chain.

8. The tool assembly of claim 1, further comprising:

said planar sides being integrally joined together to form a triangular perimeter wall having open ends, said perimeter wall being adapted for receiving a chain through the open ends for coupling a link of the chain to another link of the chain such that the chain is coupled to the main member to facilitate pulling of the main member outwardly with respect to the vehicle using the chain.

9. A realignment tool assembly for realigning a door post of a vehicle, the device comprising:

a generally triangular main member having three substantially planar sides, each planar side having an interior face and an exterior face;

a first one of said planar sides having a generally round aperture extending through the first planar side, said first one of said sides further having a chain slot extending outwardly from said aperture;

a second one of said planar sides having a pair of door hinge slots extending through the second planar side;

a pair of brackets, each bracket being couplable to a respective one of said door hinge slots, said brackets each being adapted for engaging a respective end of a door hinge on the door post of the vehicle whereby the tool assembly is couplable to the vehicle door post;

a third one of said planar sides having a plurality of bolt slots extending through the third planar side, said bolt slots being configured such that said bolt slots are adapted to be couplable to hinge bolts on the door post of the vehicle;

wherein said door hinge slots are coaxially aligned with respect to each other for permitting sliding of the brackets within the door hinge slots to accommodate coupling to door hinges having a range of hinge lengths;

wherein the plurality of bolt slots include a first bolt slot, said first bolt slot having a longitudinal axis substantially aligned with a longitudinal axis of said third planar side;

said plurality of bolt slots including a second bolt slot and a third bolt slot, said second and third bolt slots being positioned such that respective longitudinal axes of the second and third bolt slots converge and intersect with each other and the longitudinal axis of the third planar side such that said plurality of bolt slots are adapted for coupling to various bolt patterns used to attach door hinges to different vehicles whereby said tool assembly is adapted for coupling to the door posts of different vehicles;

said pair of brackets each having a first and a second planar flange, said second flange extending orthogonally from a side of said first flange, each first flange having a bolt hole extending through the first flange, each second flange having a hinge post hole extending through the second flange;

said hinge post holes being alignable such that said hinge post holes are adapted for engaging respective ends of the hinge post of the vehicle;

a pair of bracket bolts and a pair of bracket nuts;

said bracket bolts being for insertion through said bolt holes and said hinge post slots and engaging said bracket nuts whereby said second planar side and said brackets are coupled to each other such that said tool assembly is adapted to facilitate pulling of the hinge post outwardly with respect to the vehicle to realign the door post of the vehicle;

wherein said aperture is adapted for passing a chain through said aperture;

wherein said chain slot is adapted for positioning a link of the chain in the chain slot such that an adjacent link in the chain is prevented from passing through the chain slot whereby said first side is adapted for coupling to a chain to facilitate pulling of the main member using the chain; and said planar sides being integrally joined together to form a triangular perimeter wall having open ends, said perimeter wall being adapted for receiving a chain through the open ends for coupling a link of the chain to another link of the chain such that the chain is coupled to the main member to facilitate pulling of the main member outwardly with respect to the vehicle using the chain.

* * * * *